US007344103B1

(12) United States Patent
Eley

(10) Patent No.: US 7,344,103 B1
(45) Date of Patent: Mar. 18, 2008

(54) VERTICALLY WOUND REEL ASSEMBLY

(75) Inventor: Craig Eley, Lincoln, NE (US)

(73) Assignee: Eley Corporation, Lincoln, NE (US)

( * ) Notice: Subject to any disclaimer, the term of this patent is extended or adjusted under 35 U.S.C. 154(b) by 0 days.

(21) Appl. No.: 11/725,730

(22) Filed: Mar. 20, 2007

(51) Int. Cl.
*B65H 57/28* (2006.01)

(52) U.S. Cl. ..... 242/397.2; 242/395; 242/597.7

(58) Field of Classification Search ..... 242/279, 242/397.2, 390, 390.8, 395, 397.4, 397.5, 242/597.7; 254/385
See application file for complete search history.

(56) References Cited

U.S. PATENT DOCUMENTS 232,168 A * 9/1880 Beardslee ..... 242/597.7
1,437,597 A * 12/1922 Lamb ..... 242/597.7
1,488,541 A * 4/1924 Hasen ..... 242/597.7
1,955,785 A * 4/1934 Arkema et al.
2,170,459 A * 8/1939 Motkowicz et al. ..... 242/397.2
2,999,654 A * 9/1961 Fuller
4,015,795 A * 4/1977 Chong ..... 242/597.7
4,508,291 A * 4/1985 Kosch ..... 242/597.7
6,056,226 A * 5/2000 Green ..... 242/395

* cited by examiner

*Primary Examiner*—William A Rivera
(74) *Attorney, Agent, or Firm*—Holland & Hart

(57) ABSTRACT

A reel assembly is provided that rotatably couples a hub to a support, such that the hub is generally, vertically positioned. A frame is coupled with the support so that the frame may rotate about a generally vertical axis, independently of the hub and the support. A level-wind system is coupled with the frame so that the level-wind may reciprocally, vertically move a flexible line as the hub is rotated. A cover assembly may be provided to substantially enclose the hub while permitting the hub to freely rotate within the cover. A distal end of the support may be coupled with a nearly limitless number of different bases for portable and permanently mounted uses.

17 Claims, 6 Drawing Sheets

VERTICALLY WOUND REEL ASSEMBLY

BACKGROUND

Reel assemblies are commonly used to support and store elongated flexible lines, such as hoses, ropes, electrical lines and the like. Oftentimes, such flexible lines are unwound from a reel, used, and then rewound for storage and/or transport. Commonly, in the example of a garden hose, an individual may unwind a considerable length of garden hose in their yard and deliver water to various areas throughout the yard. When the individual has completed the watering activity, the garden hose may snake along a winding path through the various areas of the yard. To be sure, it is far less common to unreel a length of garden hose directly away from the reel, use it and then reel it straight back to the reel. Reeling the garden hose onto the reel when the garden hose does not extend straight out from the reel may be a difficult task. The individual may need to physically guide the hose with one hand while operating the reel with the other hand in order to evenly wind the garden hose about the reel. This is less than desirable because it greatly increases the force required to operate the reel, which can tire an individual, who is manually operating the reel, or burn out an electric motor. Irrespective of short term concerns, the increased forces on the reel assembly decrease its durability and usability long term. Moreover, guiding the garden hose manually can be a messy annoyance on occasion.

Level-wind systems have been used in the past to help guide hoses as they are wound onto horizontally disposed reels. Such level-wind systems are helpful to users for the simple reason that they do not need to manually guide the hose as it is wound onto the reel. However, the increased forces placed upon the reel assembly due to the hose being wound from an other than perpendicular direction with respect to the reel will still limit the reel assembly's durability and usability on both short term and long term bases.

Prior reel assemblies have been known to use a swivel that permits horizontally disposed reels to pivot into the direction that a hose is being reeled or unreeled therefrom. Such an arrangement provides a limited solution to the problem presented by reeling the hose toward the reel at an angle. However, such an arrangement will cause the reel assembly to track back and forth in response to the hose being wound evenly along the reel in a back and forth fashion. The forces exerted on such reel assemblies and level-wind systems associated therewith place an undue amount of strain on the working components and decrease the usable life of such systems. The agitating back and forth movement of the reel assemblies also tend to cause portable units to tip and fall, which can damage the reel assembly and other articles or individuals near the assembly when it falls. Moreover, prior reel assemblies that use a level wind system and a pivot base, typically suffer from another problem in that the crank handle, which is oftentimes positioned on the side of the assembly, may become positioned between the reel and another object, such as the side of a house, thus making any reeling function awkward at best.

Accordingly, what is needed is a novel reel assembly that greatly limits adverse external forces applied to the reel assembly when a flexible line is wound onto or from the reel in other than perpendicular directions from the reel. However, such a reel assembly should be relatively simple in construction and use.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A reel assembly of the present invention is provided for use with at least one length of flexible line, such as a hose, cord, electrical line, or the like. A reel assembly of the present invention is generally comprised of a support member, having first and second end portions. A hub, having an exterior surface adapted to support the flexible line, is rotatably coupled with the first end portion of the support member in a manner that positions the hub to rotate about a generally vertical axis. A frame is operatively coupled with the support member so that the frame may rotate about a generally vertical axis, independently of the hub and the support. A level-wind system may be coupled with the frame so that the level-wind may reciprocally, vertically move the flexible line with respect to the hub as the flexible line is wound and unwound therefrom. A cover assembly may be provided to at least substantially enclose the hub, while permitting the hub to freely rotate therein.

Reel assemblies of the present invention may be provided to operate using a manual crank handle or motor that may be operatively coupled with the hub. A nearly limitless number of various bases may be coupled to the second end portion of the support to properly secure the reel assembly for portable or permanently positioned use.

It is therefore a principal object of the present invention to provide a vertically wound reel assembly that provides reeling and unreeling operations of lengths of flexible line at nearly any direction with respect to the reel assembly while exerting relatively few adverse forces on the reel assembly that would otherwise decrease its durability and usability.

A further object of the present invention is to provide a vertically wound reel assembly that uses a vertically positioned level-wind system for positioning lengths of flexible line with respect to the reel as it is wound and unwound.

Still another object of the present invention is to provide a vertically wound reel assembly with a cover assembly and level-wind system that permits the cover and level-wind system to rotate about an axis of rotation common with the reel but independently therefrom.

Yet another object of the present invention is to provide a vertically wound reel assembly that utilizes an electric motor to wind the reel and automatically actuate a vertically disposed level-wind system.

A further object of the present invention is to provide a vertically wound reel assembly that utilizes a top-mounted crank handle to manually wind the reel assembly and automatically actuate a vertically oriented level-wind system.

Still another object of the present invention is to provide a vertically wound reel assembly that may be coupled with a nearly unlimited number of different bases, which permit the reel assembly to be portable or permanently mounted for various uses.

Yet another object of the present invention is to provide a vertically wound reel assembly that has a relatively low center of gravity.

A further object of the present invention is to provide a vertically wound reel assembly that is comprised of relatively few components.

Still another object of the present invention is to provide a vertically wound reel assembly that is relatively simple in use and assembly.

These and other objects of the present invention will be apparent after consideration of the Detailed Description and Figures herein.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
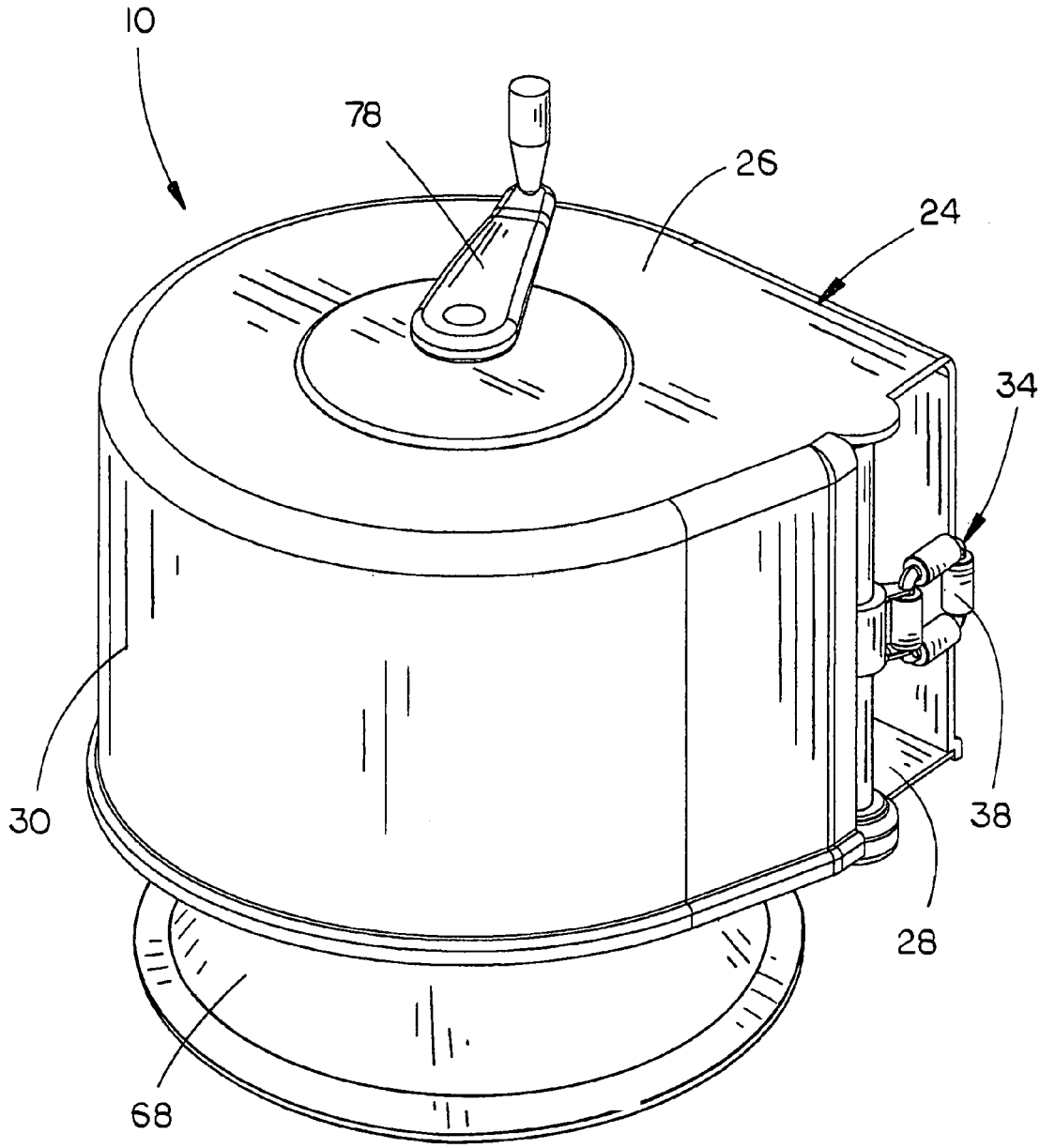
FIG. 1 depicts a perspective view of one preferred embodiment of the reel assembly of the present invention.
Figure 2:
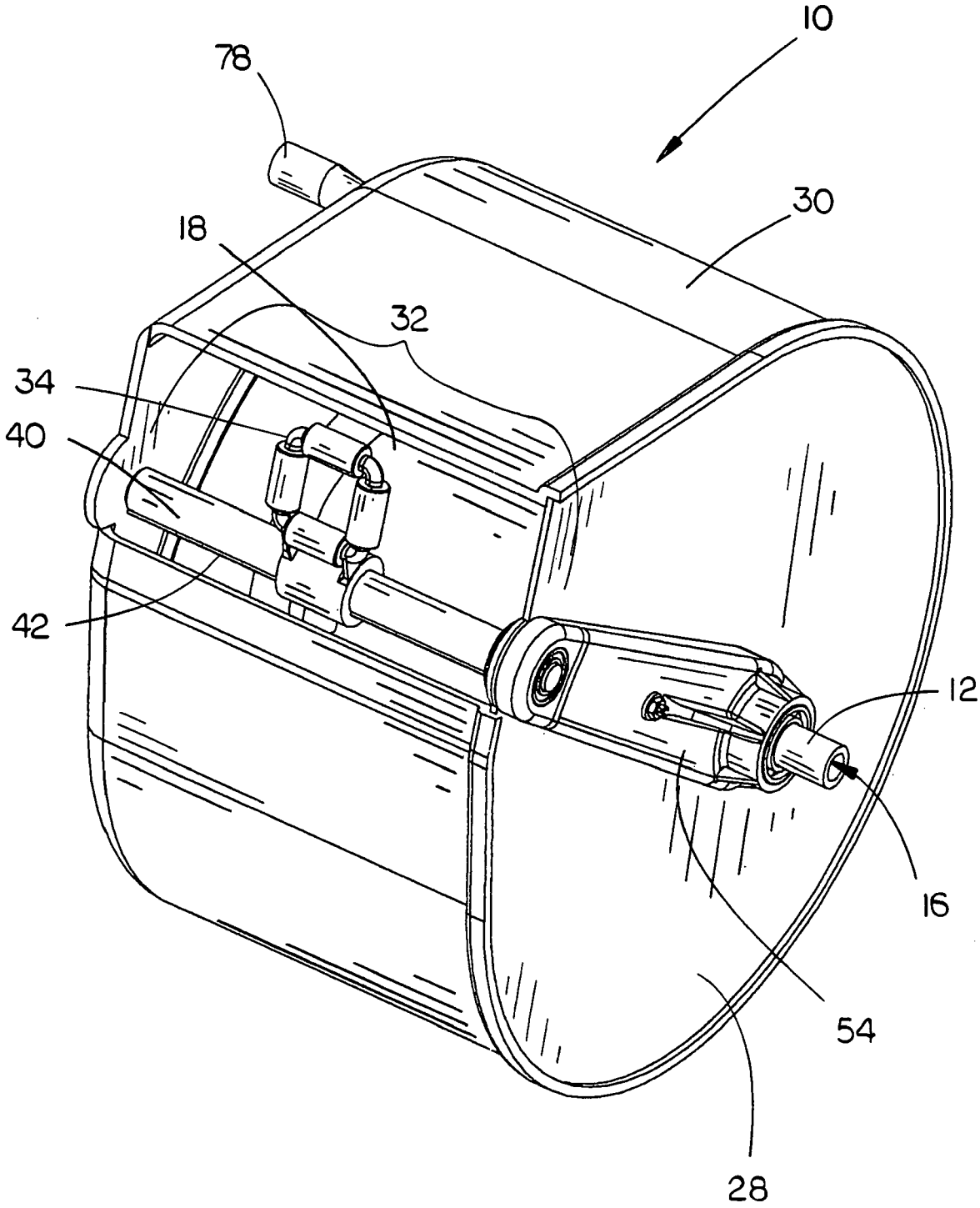
FIG. 2 depicts a partial, lower, perspective view of the reel assembly depicted in FIG. 1.
Figure 3:
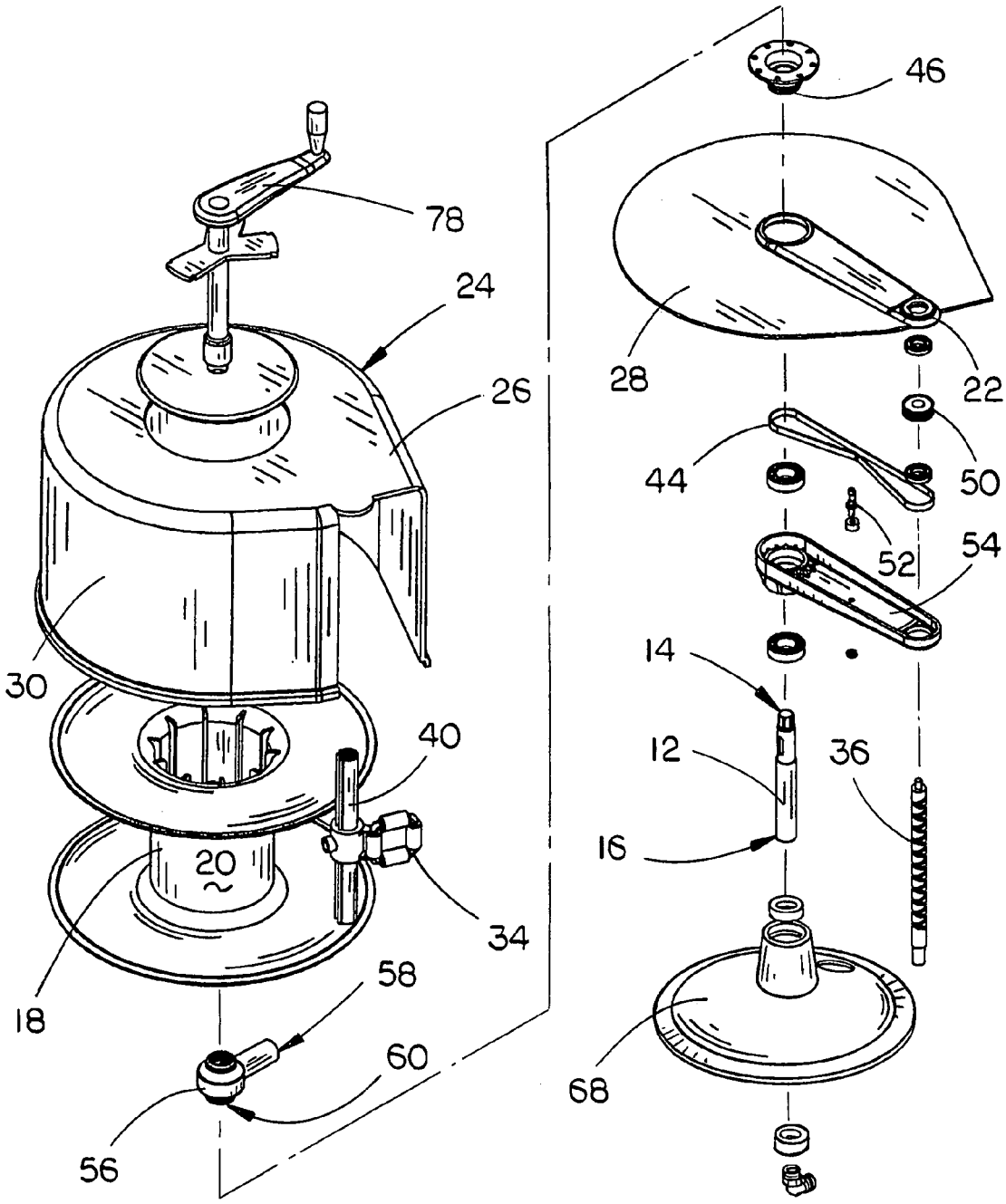
FIG. 3 depicts an exploded view of the reel assembly depicted in FIG. 1.
Figure 4:
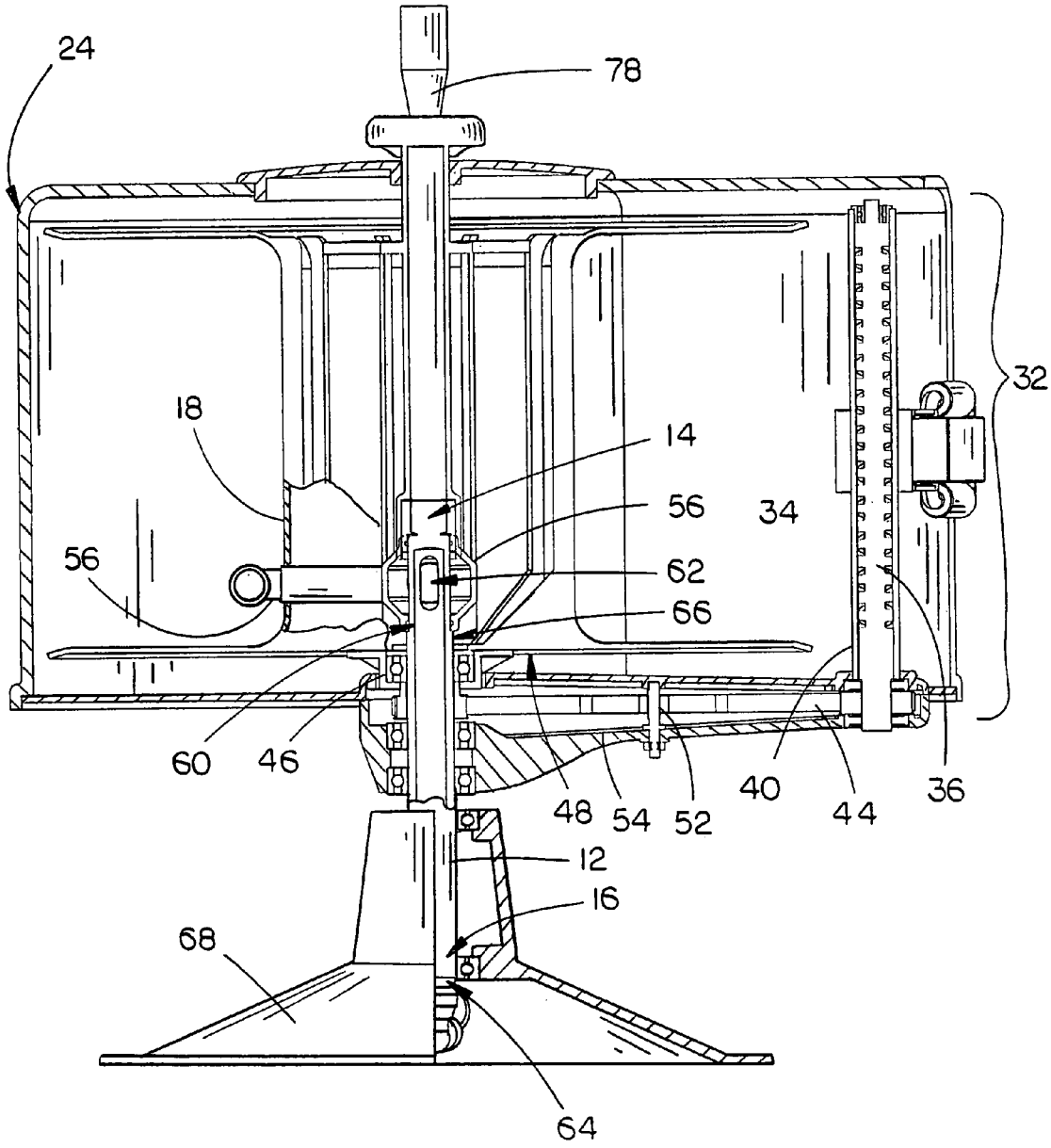
FIG. 4 depicts a partial, cut-away elevation view of the reel assembly depicted in FIG. 1.
Figure 5:
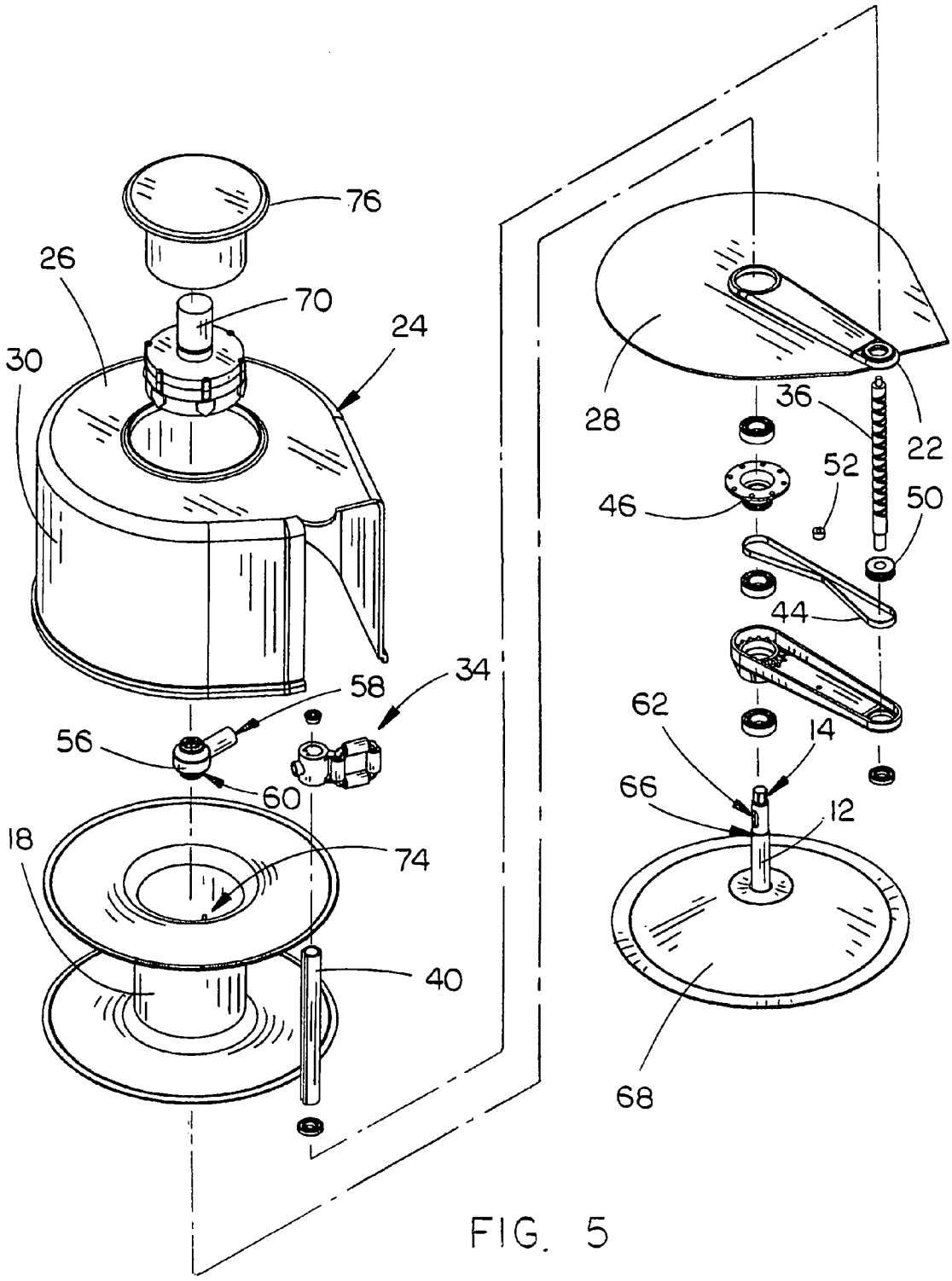
FIG. 5 depicts a partial, exploded view of another preferred embodiment of the reel assembly of the present invention.
Figure 6:
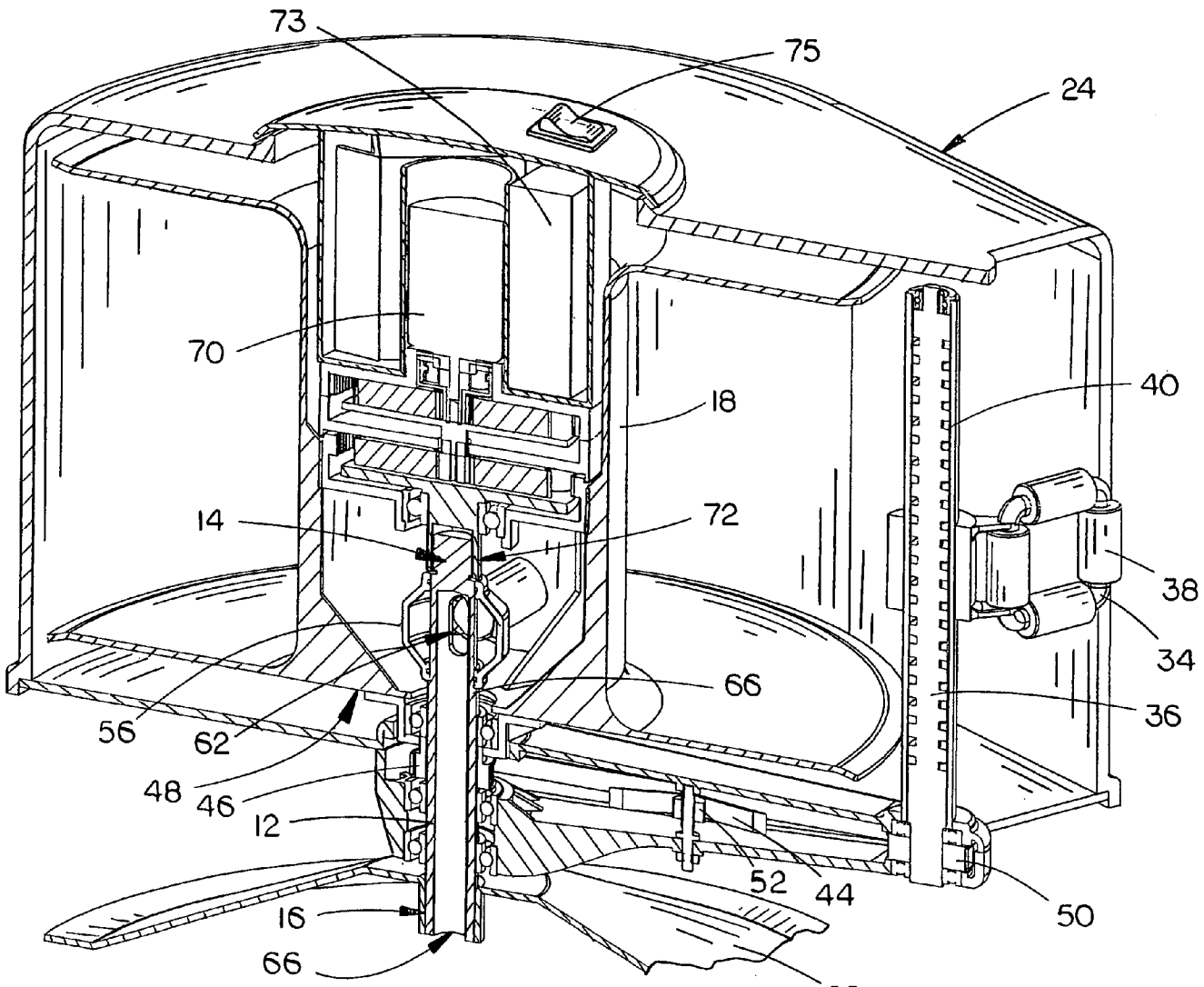
FIG. 6 is a partial, cut-away view of the reel assembly depicted in FIG. 5.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

A reel assembly 10 of the present invention is provided for use with at least one elongated flexible line, such as a hose, cord, electrical line, or the like. The reel assembly is generally provided with a support member 12, having a first end portion 14 and a second end portion 16. A hub 18, having an exterior surface 20 adapted to support the flexible line, is operatively, rotatably coupled with the first end portion 14 of the support member 12 in a manner that positions the hub 18 to rotate about a generally vertical axis. A frame 22 is operatively coupled with the support member 12 so that the frame 22 may rotate about a generally vertical axis, independently of the hub 18 and the support member 12. In one embodiment, the frame 22 may be provided in the form of a cover 24, having an upper wall 26 and a lower wall 28. A side wall 30 may extend between the upper wall 26 and the lower wall 28 to complete the cover 24. While the cover 24 may be provided to at least substantially enclose the hub 18, it will be important that the hub 18 be permitted to freely rotate within the cover 24.

The reel assembly 10 is further preferably provided with a level-wind system 32, which should be operatively coupled with the frame 22 so that the level-wind system 32 may reciprocally, vertically move the flexible line. In one preferred embodiment, the level-wind system 32 is comprised of a carriage 34 that is coupled with an elongated reciprocal gear 36, having a long axis that is generally parallel with the axis of rotation of the hub 18. In at least one preferred embodiment, the carriage 34 is shaped to loosely receive the body of a flexible line. One or more rollers 38 may be associated with the carriage 34 to promote smooth travel of the flexible line therethrough. An elongated slider tube 40 may be coaxially disposed about the reciprocal gear 36 as depicted in the Figures. An opening 42 should be formed in the slider tube 40 in order to permit engagement between the carriage 34 and teeth associated with the reciprocal gear 36. While the Figures depict the level-wind system 32 as being coupled with the upper wall 26 and the lower wall 28 of the cover 24, it is contemplated that a more rudimentary frame 22 may be provided for the sole purpose of supporting and positioning the level-wind system 32 with respect to the hub 18.

Preferably, the level-wind system 32 will operate in response to rotation of the hub 18. Accordingly, the reciprocal gear 36 may be operatively coupled with the hub 18 via a belt 44, chain, or the like. In one embodiment, a level-wind pulley 46 may be coupled with a lower end portion 48 of the hub 18. A level-wind pulley 50 may be associated with the reciprocal gear 36. The belt 44 may be positioned to operatively engage the level-wind pulleys 46 and 50. At least one tension roller 52 may be positioned to selectively move against and away from the belt 44 to increase or decrease a degree of tension placed on the same. An optional belt guard 54 may be provided to enclose the belt 44 and any associated components from the elements.

In a preferred embodiment, a swivel housing 56 is provided to operatively, rotatably couple the hub 18 with the first end portion 14 of the support member 12. The swivel housing 56 may be provided with an open inner chamber that extends between a first opening 58 and a second opening 60. In one preferred embodiment, the first opening 58 is positioned closely adjacent the hub 18 and is adapted to be coupled with a fitting that secures one end portion of the flexible line or couple directly therewith out the use of such a coupling. The second opening 60 should be operatively coupled with the first end portion 14 of the support member 12. In at least one preferred embodiment, the support member 12 is provided with an open passageway that extends between at least one opening 62 in the first end portion 14 and at least one opening 64 in the second end portion 16 of the support member 12. When assembled, it will be preferred that the fluid passageway of the support member 12 be in open fluid communication with the open inner chamber of the swivel housing 56. Accordingly, in this manner, an inlet line for the delivery of one of various fluids may be operatively coupled with the second end portion 16 of the support member 12 to deliver the fluid through support member 12, swivel housing 56 and hub 18 to the flexible line supported thereon.

The support member 12 may be formed to have a shoulder 66, or similar structure, formed in the first end portion 14. A lower end portion of the swivel housing 56, adjacent the second opening 60, may be adapted to engage, and be supported by, the shoulder 66, while permitting the swivel housing 56 to rotate with respect to the support member 12. The second end portion 16 of the support member 12 may be operatively coupled with a nearly limitless number of base structures, such as the base member 68 depicted in the Figures. While the base member 68 is depicted as being sized and shaped to support the reel assembly 10 above a generally horizontal operating surface, it is contemplated that other, similarly stable designs would suffice. Moreover, the base member 68 may be provided in a manner that produces a portable or permanently mounted arrangement.

In at least one preferred embodiment, a motor is operatively coupled with the hub 18 to selectively, automatically rotate the hub 18 with respect to the support member 12. In such an embodiment, the motor may take the form of an electric motor 70, having an output shaft 72. The electric motor 70 may be provided in a cordless fashion wherein internal batteries 73, which may be disposable or rechargeable, drive the electric motor 70. Controls 75 may be provided to actuate the electric motor 70 or vary its mode of operation. Power cords may also be associated with the electric motor 70 for directly powering the same or charging one or more batteries associated therewith. In one embodiment, the motor may be at least partially disposed within an open interior cavity 74 of the hub 18 so that the output shaft 72 may be operatively coupled with the first end portion 14 of support member 12. An opposite end portion of the electric motor 70 may be operatively coupled with the hub 18, preferably within the open interior cavity 74. A cover 76 may be provided to house components to the motor 70. While an electric motor 70 is preferred, it is contemplated that other motor types may be used in its place.

In another embodiment, a crank handle 78 may be operatively coupled with the hub 18 to selectively, manually rotate the hub 18 with respect to the support member 12. In one embodiment, the crank handle may be positioned at a top portion of the reel assembly 10 to rotate about a common axis with the hub 18. In such an embodiment, the crank handle 78 may extend at least partially within the open interior cavity 74 of the hub 18 to operatively engage a bushing, which allows the crank handle 78 to rotate on the first end portion 14 of support member 12.

Positioning of the swivel housing 56 at a lower end portion of the hub 18 promotes stability of the reel assembly 10 as it is rotated as engagement of the swivel housing 56 is generally positioned below a center of gravity for the reel assembly 10. Accordingly, where a motor is utilized, positioning of the motor at least partially within the open interior cavity 74 of the hub 18 will further promote stability of the reel assembly 10 by promoting a relatively low center of gravity for the system.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

What is claimed is:

1. A reel assembly for at least one flexible line, the reel assembly comprising:

a support member having first and second end portions;

a hub, having an exterior surface adapted to support the flexible line, rotatably coupled with the first end portion of said support member in a manner that positions said hub to rotate about a generally vertical axis;

a frame, operatively coupled with said support member so that said frame may rotate about a generally vertical axis, independently of said hub and said support; and a level-wind coupled with said frame so that said level-wind may reciprocally, vertically move the flexible line.

2. The reel assembly of claim 1 wherein said frame is comprised of a cover that at least substantially encloses said hub, while permitting said hub to freely rotate within said cover.

3. The reel assembly of claim 1 wherein said level-wind is comprised of a carriage that is reciprocally, operatively coupled with an elongated reciprocal gear, having a long axis that is generally parallel with the axis of rotation of said hub.

4. The reel assembly of claim 3 wherein said level-wind is further comprised of an elongated slider tube, coaxially disposed about said reciprocal gear.

5. The reel assembly of claim 3 wherein said reciprocal gear is operatively coupled with said hub so that said reciprocal gear rotates in response to rotation of said hub.

6. The reel assembly of claim 5 further comprising a belt that operatively couples said reciprocal gear with said hub and a tension roller that is selectively movable against and away from said belt to increase or decrease a degree of tension placed on said belt.

7. The reel assembly of claim 1 further comprising a swivel housing that operatively, rotatably couples said hub within the first end portion of said support.

8. The reel assembly of claim 7 wherein said swivel housing is provided with an open inner chamber that extends between first and second openings; said first opening being positioned closely adjacent said hub and said second opening being operatively coupled with the first end portion of said support.

9. The reel assembly of claim 8 wherein said support is provided with an open fluid passageway that extends between at least one opening in the first end portion of said support and at least one opening in the second end portion of said support; the fluid passageway of said support being in open fluid communication with the open inner chamber of said swivel housing.

10. The reel assembly of claim 9 wherein the open inner chamber of said swivel housing is in open fluid communication with the at least one flexible line.

11. The reel assembly of claim 8 wherein said second opening rotatably receives the first end portion of said support and a lower end portion of said swivel housing is operatively, rotatably coupled with a shoulder formed in the first end portion of said support.

12. The reel assembly of claim 1 wherein the second end portion of said support is operatively coupled with a base member that is sized and shaped to support the reel assembly above a generally horizontal operating surface.

13. The reel assembly of claim 1 further comprising a motor operatively coupled with said hub to selectively, automatically rotate said hub with respect to said support.

14. The reel assembly of claim 13 wherein said motor is electrically driven and powered by one or more batteries.

15. The reel assembly of claim 13 wherein said motor is at least partially disposed within an open interior cavity of said hub and operatively coupled with the first end portion of said support member at a first end of said motor; said second end portion of said motor being operatively coupled with said hub.

16. The reel assembly of claim 1 further comprising a crank handle operatively coupled with said hub to selectively, manually rotate said hub with respect to said support.

17. The reel assembly of claim 16 wherein said crank handle is positioned at a top portion of the reel assembly to rotate about a common axis with said hub; said crank handle extending at least partially within an open interior cavity of said hub and operatively coupling with said hub and the first end portion of the support member.

* * * * *